United States Patent [19]

Fortmann

[11] 4,104,963

[45] Aug. 8, 1978

[54] DEVICE FOR THE PRESSURE FIXING OF TONERS

[75] Inventor: Hermann Fortmann, Wilhelmshaven, Fed. Rep. of Germany

[73] Assignee: Olympia Werke AG, Wilhelmshaven, Fed. Rep. of Germany

[21] Appl. No.: 771,347

[22] Filed: Feb. 23, 1977

[30] Foreign Application Priority Data

Feb. 23, 1976 [DE] Fed. Rep. of Germany ..... 2607271

[51] Int. Cl.[2] ..... B30B 3/04

[52] U.S. Cl. ..... 100/176

[58] Field of Search ..... 100/176, 170, 171; 68/22 A, 256, 257, 258; 432/60; 355/3 DD

[56] References Cited

U.S. PATENT DOCUMENTS

| | | | |
|---|---|---|---|
| 2,718,827 | 9/1955 | Whittum | 68/258 |
| 2,851,869 | 9/1958 | Quoos | 68/258 |
| 3,931,793 | 1/1976 | Kolibas | 100/176 |
| 3,988,061 | 10/1976 | Root | 427/22 |
| 4,022,122 | 5/1977 | Moser | 100/176 |

*Primary Examiner*—Edward J. McCarthy

*Attorney, Agent, or Firm*—Spencer & Kaye

[57] ABSTRACT

A device for the pressure fixing of a toner on a record carrier under ambient temperatures has a stand; a first pressure roll of relatively large diameter rotatably and stationarily supported in the stand; and a second pressure roll of relatively small diameter rotatably supported in the stand and cooperating with the first pressure roll to define therewith a roll gap. The second pressure roll is displaceably supported to be shiftable towards and away from the roll gap. The device further has a plurality of pressure rollers arranged in a series along the length dimension of the second pressure roll in an axially parallel orientation therewith and a support for individually displaceably supporting each pressure roller for movement towards and away from the roll gap. A separate spring urges each pressure roller into contact with the second pressure roll for exerting thereon a pressing force with which the first and second rolls compress a record carrier passing through the roll gap. With each pressure roller there is associated a setting mechanism for individually adjusting the pressing force exerted by each pressure roller.

8 Claims, 3 Drawing Figures

DEVICE FOR THE PRESSURE FIXING OF TONERS

BACKGROUND OF THE INVENTION

This invention relates to a device for fixing a toner image on a record carrier at normal ambient temperatures. The toner image is obtained by a direct or an indirect electrostatic copying process. The device is of the type that has two unheated, rotarily supported pressure rolls having unlike diameters. The pressure roll having the smaller diameter is displaceable in the direction of the roll gap and is urged, by a spring arrangement, against the other roll.

In direct or indirect electrostatic copying process for the fixing of a developed image (consisting of an appropriate toner) on a permanent record carrier, such as different types of papers, like regular paper, laminated papers with photosemiconductor layers, transparent papers, paper and offset sheets, such as synthetic sheets as used in daylight projectors, generally two types of processes are used: The toner particles are melted by the application of heat and the carrier liquids in which the toner is suspended are vaporized. In order to accelerate the vaporization, the copy is often exposed to an air stream of ambient or elevated temperatures.

Further there are known processes which utilize heated rolls for the fixing operation.

All these processes have the disadvantage that until the copying apparatus is ready to operate, an appropriate heat-up period is necessary which may last from a few seconds to minutes. Further, in order to ensure that the heating temperature is maintained at a constant value, monitoring and control devices are necessary, which have to be adjustable, dependent upon the particular material of the copy. Further, there is a risk of overheating, for example, in case of a power failure, which may lead to the destruction of the photosemiconductor layers, particularly if selenium is used as the photosemiconductor. In wet developing processes it is of disadvantage that the copies are not always dry as they are discharged from the apparatus. Also, for the fixing with the aid of heat often a high energy input is necessary which has to be controlled by appropriate control arrangements.

If the apparatus operates with heated rolls, the latter have to be provided with coatings for preventing the melting of the toner onto the rolls and to eliminate soiling thereof. These coatings, however, have only a limited life expectancy and thus have to be replaced after a predetermined number of copying operations.

Recently, as a result of developing new toners, another fixing process has been introduced wherein the toner image is fixed without the application of heat by means of an appropriately high pressure generated by two cooperating rolls.

In order to obtain a non-smudging copy, pressures of 5 kilopond/millimeter of roll length and more are used which have to be generated by pressing the upper and the lower rolls to one another. This pressure has to be applied uniformly over the entire roll gap in order to ensure a uniform fixing.

German Laid-Open Application (Offenlegungsschrift) No. 2,341,530 discloses an arrangement in which the upper and lower rolls are pressed to one another at both ends by means of a spring-loaded bearing bracket of hinging construction. Additionally, the two rolls are slightly non-parallel so that the contact line is a largepitch helix by virtue of an additional elastic bending deformation of both rolls. In this arrangement, however, a uniform pressure over the entire length of the helix can be obtained only if springs biased with narrow tolerances are used and further, the necessary torque is relatively high. It was further found that in case of a nonoptimal adjustment of the pressure at the contact line, the throughgoing copy tends to crease which would render it unusable.

Another apparatus is disclosed in German Laid-Open Application (Offenlegungsschrift) No. 2,353,835 which also utilizes unheated rolls. One of these unheated rolls is provided with a deformable coating which is purported to ensure a uniform pressure distribution over the roll length. It is a disadvantage of such an arrangement that in case of longer standstill periods plastic deformations may occur which do not regenerate and thus the apparatus will not operate properly. Therefore, if longer standstill periods are anticipated, the rolls have to be relieved of the pressing force; this necessitates increased expense and, if such a pressure release is not effected, malfunctions may occur.

SUMMARY OF THE INVENTION

It is an object of the invention to provide an improved fixing device which operates at ambient temperatures and which, on the one hand, ensures as uniform a pressure distribution as possible over the entire contact line of the pressure rolls and, on the other hand, makes possible various pressure adjustments dependent upon the particular toners and/or record carriers being used; and which further ensures that the set values are maintained constant throughout long periods and that, in case of different distribution of the toner on the record carrier, uniform results are obtained.

These objects and others to become apparent as the specification progresses, are accomplished by the invention, according to which, briefly stated, the device for the pressure fixing of a toner on a record carrier under ambient temperatures has a stand; a first pressure roll of relatively large diameter rotatably and stationarily supported in the stand; and a second pressure roll of relatively small diameter rotatably supported in the stand and cooperating with the first pressure roll to define therewith a roll gap. The second pressure roll is displaceably supported to be shiftable towards and away from the roll gap. The device further has a plurality of pressure rollers arranged in a series along the length dimension of the second pressure roll in an axially parallel orientation therewith and a support for individually displaceably supporting each pressure roller for movement towards and away from the roll gap. A separate spring urges each pressure roller into contact with the second pressure roll for exerting thereon a pressing force with which the first and second rolls compress a record carrier passing through the roll gap. With each pressure roller there is associated a setting mechanism for individually adjusting the pressing force exerted by each pressure roller.

It is an advantage of the device structured according to the invention that sufficiently uniform pressing forces can be generated over the entire roll length with simple means to thus ensure an impeccable fixing of the toner for different record carriers. The invention does not set additional requirements concerning the cylindricity and roundness of the rolls and it ensures that flawless results are achieved even in case of different effective materials and record carriers of different thicknesses. The desired pressing force with which the rolls are urged to one another can be set in a simple manner. Creasing of the record carrier is also avoided by applying to the inner (middle) pressure rollers a somewhat greater force than that applied to the outer (flanking) pressure rollers. It is a further advantage of the invention that by virtue of the individually settable pressure rollers there is achieved a reduction of the pressing force to be generated per length unit and therefore a reduction of the overall torque in the apparatus is obtained.

DESCRIPTION OF THE PREFERRED EMBODIMENTS

Figure 1:
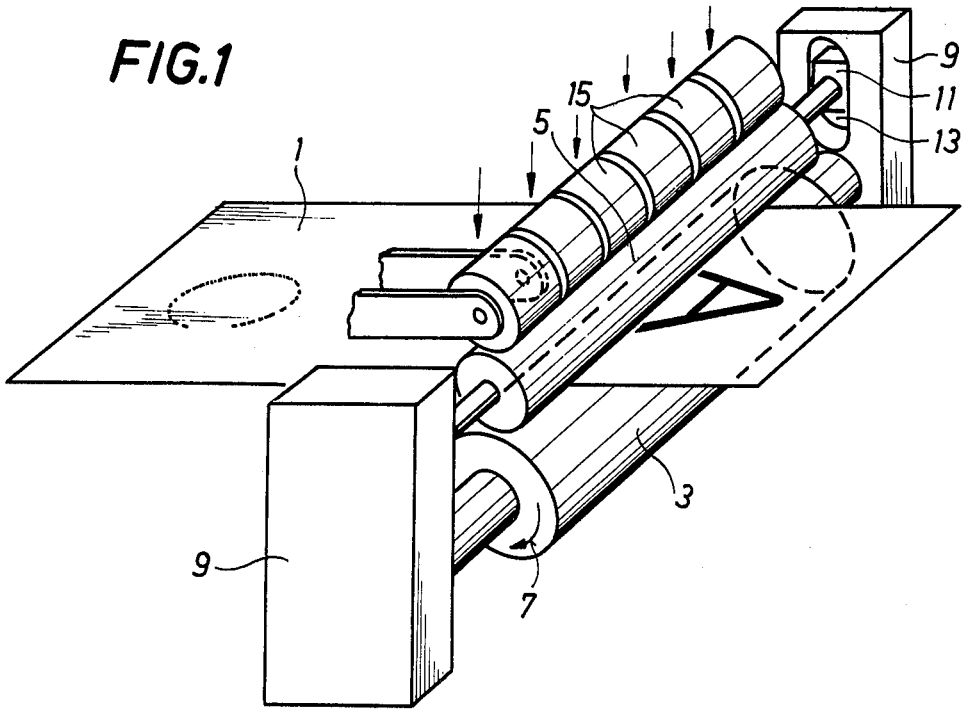
FIG. 1 is a fragmentary schematic perspective view of a preferred embodiment of the invention.

Turning now to FIG. 1, there are shown the essential components of a pressure fixing device for fixing a copy made electrophotographically with a direct or indirect process. This fixing device is, for example, part of a copier in which, by means of a direct process, an image or the like is transferred as a charge relief to a coated record carrier, for example a paper sheet. As this record carrier passes through a developing station, including, for example, a magnetic brush, the negative locations on the record carrier take up positively charged toner particles. The developed copy 1 is then forwarded, on a glide surface (not shown), to the pressure rolls 3 and 5, of which, for example, the pressure roll 3 is driven in the direction of the arrow 7. The pressure rolls 3 and 5 are made of a metal having a hard surface. At least that pressure roll 3 or 5 is provided with a smooth surface which, as the record carrier 1 passes through the pressure rolls 3 and 5, contacts the image-carrying surface of the record carrier. For this purpose the roll surface is polished with precision or carries a hard chrome coating. The larger pressure roll 3 is (as shown in FIG. 1) rotatably supported in a stand 9 and is rotatable by a drive (not shown). The smaller pressure roll 5 is rotatably supported in slide blocks 11 which are arranged in slots 13 in the stand 9 and thus are displaceable towards or away from the roll gap. A plurality of spring-loaded pressure rollers 15 are, in a uniform distribution, arranged along the smaller pressure roll 5 and are oriented axially parallel therewith. During the passage of the record carrier 1 the pressure rollers 15 can be brought into contact with the elastically supported smaller pressure roll 5 by virtue of the rigidly supported larger pressure roll 3 and the elastically supported smaller pressure roll 5. The pressing force of the pressure rollers 15 is individually adjustable; this feature will be described later in greater detail.

Figure 2:
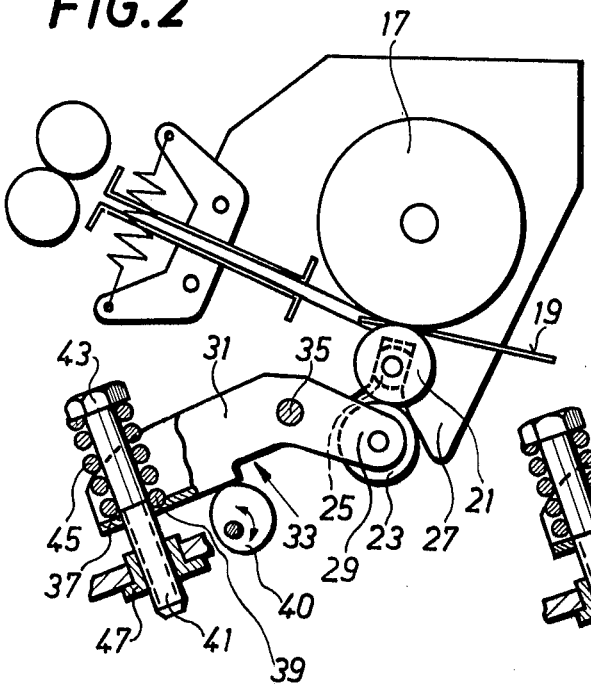
FIG. 2 is a schematic side elevational view of another preferred embodiment of the invention.

The pressure fixing device illustrated in FIG. 2 corresponds in essence to that of the FIG. 1 embodiment except that it is the larger pressure roll 17 which cooperates with the image-carrying face of the record carrier 19. This arrangement has the advantage that the pressure roll which contacts the toner on the copy can be more easily and more thoroughly cleaned. The smaller pressure roll 21 and the pressure rollers 23 are arranged underneath the larger pressure roll 17. The smaller pressure roll 21 is, similar to the FIG. 1 embodiment, displaceably supported by means of sliding blocks 25 in the stand 27.

Each pressure roller 23 is rotatably supported by an arm 29 of a two-arm pivotal lever 33 which has a saddle-shaped configuration and which is pivotally secured at 35, for example, to the stand 27. The other arm 31 of each pivotal lever 33 has a saddle 37 which is bent to assume a perpendicular orientation with respect to the pivotal direction of the pivotal lever 33 and which has a throughgoing bore 39 for a tensioning screw 41. The saddle 37 may also be formed as a component separate from the associated pivotal lever 33 to bring about in this manner a linear contact of the pressure roller 23 on the pressure roll 21. Between the head 43 of the tensioning screw 41 and the saddle 37 of the pivotal lever 33 there is arranged a compression spring 45. The tensioning screw 41 is adjustably supported in a stationary, unmovable part 47 in the stand 27. By turning the respective tensioning screw 41, the bias of each compression spring 45 and thus the pressing force of the two pressure rolls 17, 21 may be set with precision in such a manner that a uniform and good tone fixing is achieved as the record carrier 19 passes through the roll gap. The compression spring 45 may be, for example, a coil spring. It is to be understood, however, that the spring may also be formed of spring discs or may have any other configuration. Even in case of out-of-round properties of the pressure rolls 17, 21 or in case of an out-of-round run thereof, still a good pressure fixing image can be achieved since the elastically supported small pressure roll 21 may be adjusted with precision with respect to the rigidly supported larger pressure roll 17. The total force to be applied in order to achieve a uniform fixing by pressure, is in the device according to the invention significantly smaller than in known pressure fixing devices.

Figure 3:
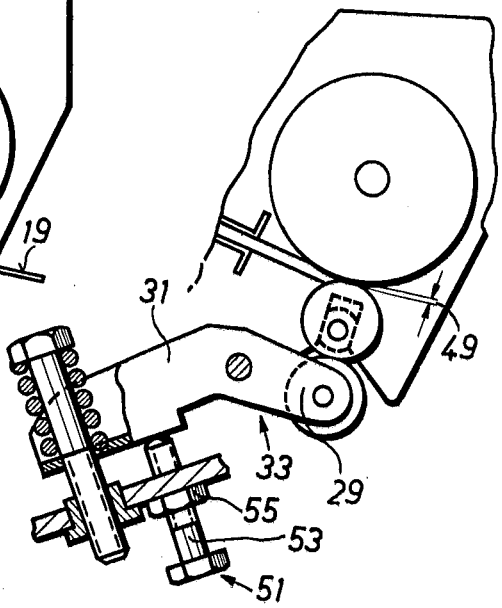
FIG. 3 is a schematic side elevational view of a modification of the embodiment shown in FIG. 2.

FIG. 3 shows an arrangement with which the pressing force can be reduced to zero in the position of rest, and wherein a minimum pressure is present in the idle run. This arrangement provides that the torque peaks are reduced at the moment the copy enters the roll gap 49. The latter is, according to FIG. 3, divided (calibrated) with high precision; the divisions of the gap are by a few 1/100 mm smaller than the thickness of the carrier material. The spring-loaded pivotal levers 33 engage in their initial position an adjustable abutment 51 which is formed of a screw 53 threadedly held in a stationary, non-displaceable component such as the stand 27. The screw 53 can be immobilized in any setting by a counter nut 55. The smaller pressure roll 21 can, as required, engage the pressure rollers 23 either by its own weight or by the effect of a weak spring in such a manner that there remains a small air gap between the pressure rolls 17 and 21. By means of the air gap 49, on the one hand, the paper in-feed is facilitated and, on the other hand, the noises of idle run and wear are significantly reduced. The air gap, however, can be only of such a magnitude that a good fixing by pressure is still ensured.

Instead of the screw 53 the adjustable abutment may be constituted by a cam disc 40 rotatably (and eccentrically) supported in the stand 27. By turning the cam disc 40, its effective height is adjustable to thus raise or lower the cam edge portion which abuts the lever arm 31.

It is to be understood that the roller support structures described in connection with FIGS. 2 and 3 are present in the FIG. 1 embodiment as well, although they are not shown there.

With the device structured according to the invention, it is possible to generate very uniform pressing forces with simple means throughout the entire roll length and thus copies having a high smear resistance can be produced. Further, the forming of solid black areas in case of charge images developed, for example, by magnetic brushes can be further improved by calender effect.

The cleaning device necessary for the functioning of the pressure rolls as well as the stripper for a secure passage of the copies through the apparatus are not illustrated since they do not form a cooperating part of the invention.

It will be understood that the above description of the present invention is susceptible to various modifications, changes and adaptations, and the same are intended to be comprehended within the meaning and range of equivalents of the appended claims.

What is claimed is:

1. In a device for the pressure fixing of a toner on a record carrier under ambient temperatures; the device including a stand; a first pressure roll of relatively large diameter rotatably and stationarily supported in the stand; a second pressure roll of relatively small diameter rotatably supported in the stand and cooperating with the first pressure roll to define therewith a roll gap; means for displaceably supporting the second pressure roll to be shiftable towards and away from the roll gap; resilient force-exerting means for urging the second pressure roll against the first pressure roll; the improvement wherein said resilient force-exerting means comprises (a) a plurality of pressure rollers arranged in a series along the length dimension of said second pressure roll; said pressure rollers being oriented axially parallel with said second pressure roll;

(b) a separate support means for individually displaceably supporting each said pressure roller for movement towards and away from said roll gap;

(c) a separate spring urging each said pressure roller into contact with said second pressure roll for exerting thereon a pressing force with which said first and second rolls compress a record carrier passing through said roll gap; and (d) setting means for individually adjusting the pressing force exerted by each said pressure roller.

2. A device as defined in claim 1, wherein each said separate support means comprises a lever pivotally supported in the stand; said lever formed of first and second lever arms; said first lever arm rotatably carrying the pressure roller and said second lever arm being in engagement with said separate spring; said setting means comprising a set screw threadedly held in a stationary component adjacent said second lever arm; said set screw being in engagement with said spring for adjusting the bias thereof upon turning said set screw in the stationary component.

3. A device as defined in claim 2, wherein said second lever arm includes a saddle portion oriented perpendicularly to the pivotal direction of the lever; said saddle portion being provided with an aperture through which said set screw passes; said set screw having a head; said spring being arranged for compression between the screw head and said saddle portion.

4. A device as defined in claim 1, wherein said first and second pressure rolls are metal rolls with a hard surface; at least one of said pressure rolls having a smooth surface for contacting the image-carrying surface of the record carrier upon its passage through said roll gap.

5. A device as defined in claim 1, wherein said second pressure roll is arranged underneath said first pressure roll and said pressure rollers are arranged underneath said second pressure roll; said second pressure roll engaging, at least by its own weight, said pressure rollers for displacing the same to define an air gap between said first and second pressure rolls; the improvement further comprising limiting means for setting the magnitude of said air gap; said air gap being smaller than the thickness of the record carrier.

6. A device as defined in claim 2, wherein said second pressure roll is arranged underneath said first pressure roll and said pressure rollers are arranged underneath said second pressure roll; said second pressure roll engaging, at least by its own weight, said pressure rollers for displacing the same to define an air gap between said first and second pressure rolls; the improvement further comprising limiting means for setting the magnitude of said air gap; said limiting means including a separate adjustable abutment associated with each said lever and supported in said stand; said separate adjustable abutment being engaged by the respective lever in the absence of a record carrier between said first and second pressure rolls; said separate adjustable abutment setting the air gap to a magnitude that is smaller than the thickness of the record carrier.

7. A device as defined in claim 6, wherein said adjustable abutment comprises a screw threadedly held in said stand.

8. A device as defined in claim 6, wherein said separate adjustable abutment is formed of a cam disc.

* * * * *